US006094956A

United States Patent [19]

Vodopyanov et al.

[11] Patent Number: 6,094,956

[45] Date of Patent: Aug. 1, 2000

[54] SUPPORT TOOL FOR DEEP ROLLING CRANKSHAFT FILLETS

[75] Inventors: Eugene Vodopyanov, Oak Park; Luis Cadena, Rochester Hills, both of Mich.

[73] Assignee: Hegenschiedt-MFD Corporation, Sterling Heights, Mich.

[21] Appl. No.: 09/230,016

[22] PCT Filed: May 13, 1998

[86] PCT No.: PCT/US98/09524

§ 371 Date: Jan. 15, 1999

§ 102(e) Date: Jan. 15, 1999

[87] PCT Pub. No.: WO98/51432

PCT Pub. Date: Nov. 19, 1998

Related U.S. Application Data

[60] Provisional application No. 60/046,664, May 16, 1997.

[51] Int. Cl.[7] ..... B21H 7/00

[52] U.S. Cl. ..... 72/110; 29/6.01

[58] Field of Search ..... 72/107, 110; 29/6.01

[56] References Cited

U.S. PATENT DOCUMENTS 5,445,003 8/1995 Gottschalk et al. ..... 72/110

FOREIGN PATENT DOCUMENTS

H 24053 12/1956 Germany ..... 29/6.01

*Primary Examiner*—Lowell A. Larson

*Attorney, Agent, or Firm*—Howard & Howard

[57] ABSTRACT

Deep rolling equipment for cold working fillet radii of annular undercuts on opposite sides of main bearing and crank pin journals of an engine crankshaft while being rotatably driven. The equipment has pairs of jaws movable between an open position for receiving the crankshaft journal and a closed position for rolling the fillets thereof. The upper jaw mounts fillet rolling tools for high load rolling engagement in the annular undercuts and a lower tool on the opposing lower jaw for support of the journal. The lower tool has a pair of support rollers with annular journal support portions which contact and support the journal while the fillet radii of the undercuts on either side of the journal are being rolled. These support rollers importantly have work stabilizing annular flanges outboard of the support portion with larger diameters that ride in the undercuts and limit lateral movement of the crankshaft with respect to the rolling and support tools so that the crankshaft is not abraded or otherwise damaged by side contact of the jaws and tools with portions of the crankshaft.

11 Claims, 4 Drawing Sheets

FIG - 4
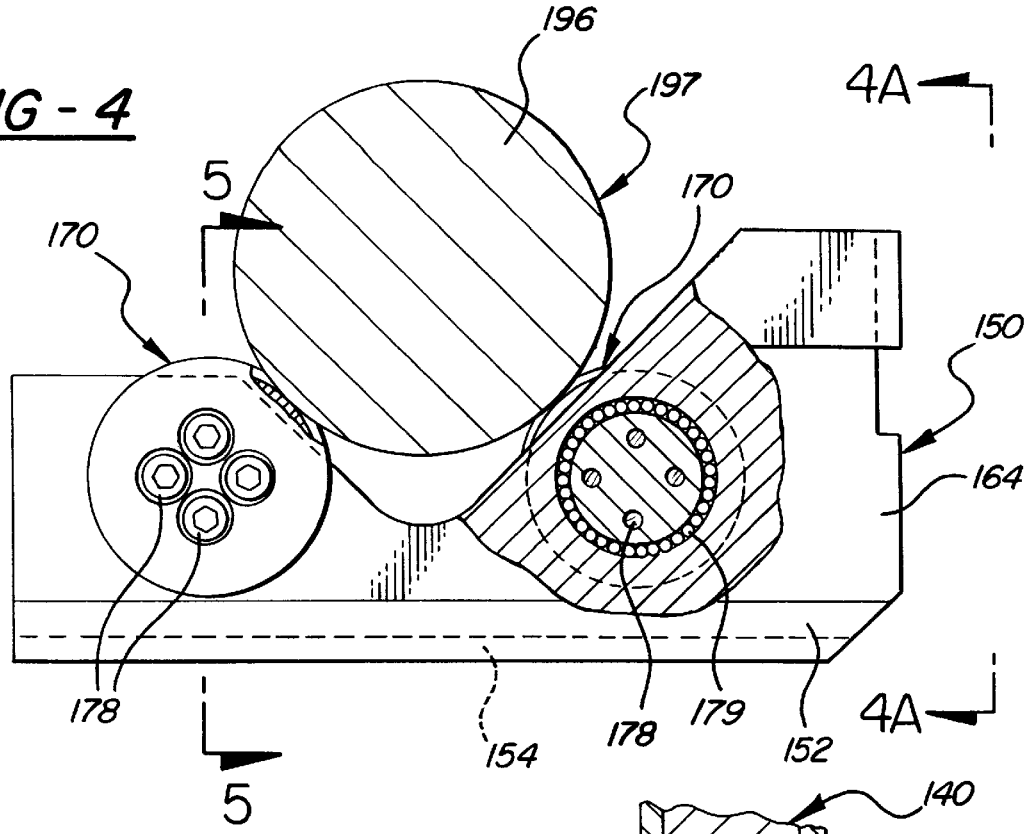
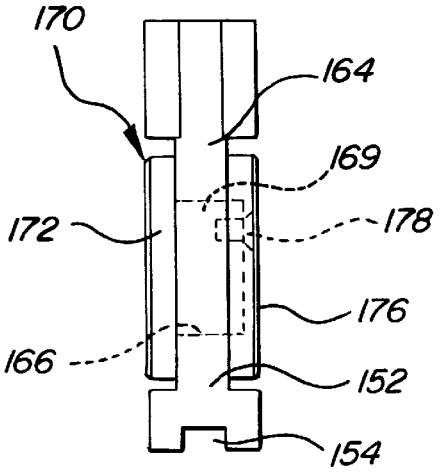
FIG - 4A
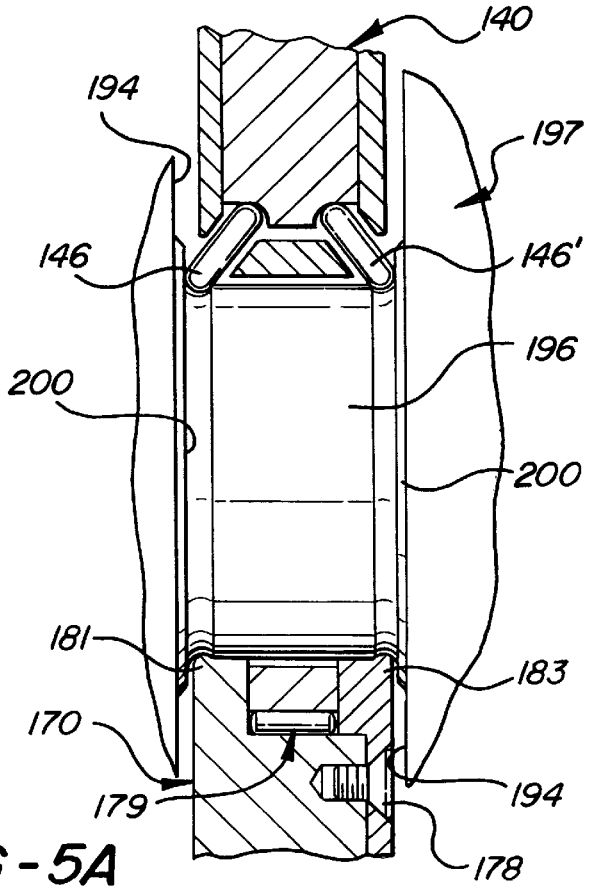
FIG - 5A

SUPPORT TOOL FOR DEEP ROLLING CRANKSHAFT FILLETS

This application claims the benefit of U.S. Provisional Application No. 60/046,664 filed May 16, 1997.

TECHNICAL FIELD

The present invention relates to a lower support tool for deep rolling fillets of a crankshaft. More specifically, the invention relates to a new and improved apparatus for limiting relative lateral movement between the crankshaft and the fillet rolling is tools of a jaw assembly during rolling operation.

BACKGROUND ART

Deep rolling of crankshaft journal fillets for crankshaft strengthening purposes is well known in the art. The journals of a crankshaft for internal combustion engines are disposed between laterally spaced counterweights formed on the crankshaft. The journal fillets are located at the intersection of the journal and the adjacent counterweight and define concentrated annular areas of high stress which must be mechanically relieved to improve crankshaft strengths in these otherwise weakened areas. Various arrangements of floating jaw units are employed at each journal to mechanically roll the fillets and relieve such stresses and strengthen them.

Generally, each jaw unit has opposing upper and lower jaw arms, which are pivotally connected to one another. The jaw arms have facing jaws that are adapted to close about a journal during the deep rolling operation. A hydraulic cylinder is disposed between the opposing end of the jaw arms and is adapted to open and close the facing jaws about the journal and apply a working force to the fillets. More particularly, the jaw of the upper arm has tooling which includes rollers which engage and mechanically work the journal fillets while the opposing jaw of the lower arm has tooling with support rollers that support the journal during fillet rolling. Accordingly, a portion of each jaw unit and the tooling must be in close proximity to the journal and hence the interfacing side wall of the counterweights or other part of the crankshaft while the journal fillets are being rolled.

Prior to the present invention, a linkage has been operatively connected to the lower arm or jaw to limit any tendency of the jaw assembly to move laterally relative to the journal that, for example, may result from a taper of the journal. However, even with such a linkage, lateral movement may occur to such an extent that the flanks or sides of the counterweights or other adjacent portions of the crankshaft are contacted and abraded by the tools or a portion of the jaw assembly. This may cause crankshaft damage and result in part rejection of the crankshaft and re-machining or scrapping of the part. The fillet rolling tools can also be damaged from such contact during deep rolling resulting in production down time for machine repair and tool replacement.

SUMMARY OF THE DISCLOSURE AND ADVANTAGES

The present invention seeks to overcome such problems by improving control over any tendency of the crankshaft to move laterally during fillet rolling by providing a new and improved lower crankshaft support tool which is carried by the lower jaw arm. The lower support tool includes laterally spaced large diameter annular flanges which operatively fit into the annular undercuts or fillets at both sides of the journals of a crankshaft to contact portions of these undercuts to limit lateral shifting of the crankshaft relative to the tooling to improve rolling operation. The upper tool and other components of the jaw assembly may be substantially the same as the prior art.

According to one preferred embodiment of the present invention, there is provided a lower support tool adapted to prevent lateral movement between the crankshaft and the jaw assembly of the fillet rolling machine, which can be used with or replace the lateral movement control linkage of the prior art. The lower support tool includes a roller support housing that is adapted to be attached to the lower arm of a journal fillet rolling jaw assembly. The roller support housing has two spaced apart transverse circular apertures therethrough. A roller unit having a pair of spaced apart flanges extending outwardly from its outer cylindrical surface is associated with each aperture. A crankshaft journal is disposed between and is supported by the roller units, and more specifically, by the cylindrical surface of each unit. The flanges of each roller unit align and fit into and coact with the opposing journal fillets when the crankshaft journal is supported during rolling. Thus the modified lower support tool of the present invention laterally locates the journal, and hence the adjoining surfaces and counterweights, relative to the lower support tool thereby preventing the jaw assembly from laterally moving relative to the crankshaft and contacting and abrading such surfaces and the sides of the counterweights.

An object, feature and advantage of this invention is to provide a new and improved work support tool for use in fillet rolling equipment for rolling annular fillets of journals of engine crankshafts. The support tool preferably has a pair of centralized cylindrical support wheels that rolls and contacts and support the journal as the crankshaft is being turned and further has laterally, spaced retainer flanges for operatively fitting into the laterally spaced and annular undercuts on opposite sides of a cylindrical journal of the crankshaft. The laterally spaced retainer flanges having diameters greater than the diameter of the annular journal contact surface and are operative to limit the lateral (axial) movement of crankshaft relative to said support tool to reduce or eliminate damage to the crankshaft by the tooling.

Another object, feature and advantage of the present invention is to provide a new and improved apparatus that rollingly supports a crankshaft whose fillets are being rolled for preventing lateral movement and unwanted contact and wear between the jaw assemblies including tooling of fillet roll equipment and side faces of the crankshaft counterweights to avoid damaging the crankshaft.

Another object, feature and advantage of the present invention is to provide a new and improved lower support tool that can be used with the prior art components of the jaw assembly to improve crankshaft fillet rolling.

BRIEF DESCRIPTION OF THE DRAWINGS

Other objects, features and advantages of the present invention will be readily appreciated as the same becomes better understood by reference to the following detailed description when considered with the accompanying drawings wherein:

FIG. 4 is a side view with parts in cross-section of the new and improved lower support tool of FIG. 3;

FIG. 4A is an end view taken along lines 4*a*—4*a* of FIG. 4;

FIG. 5A is a view taken generally along sight lines 5*a*—5*a* of FIG. 3.

PREFERRED EMBODIMENT OF THE INVENTION

Figure 1:
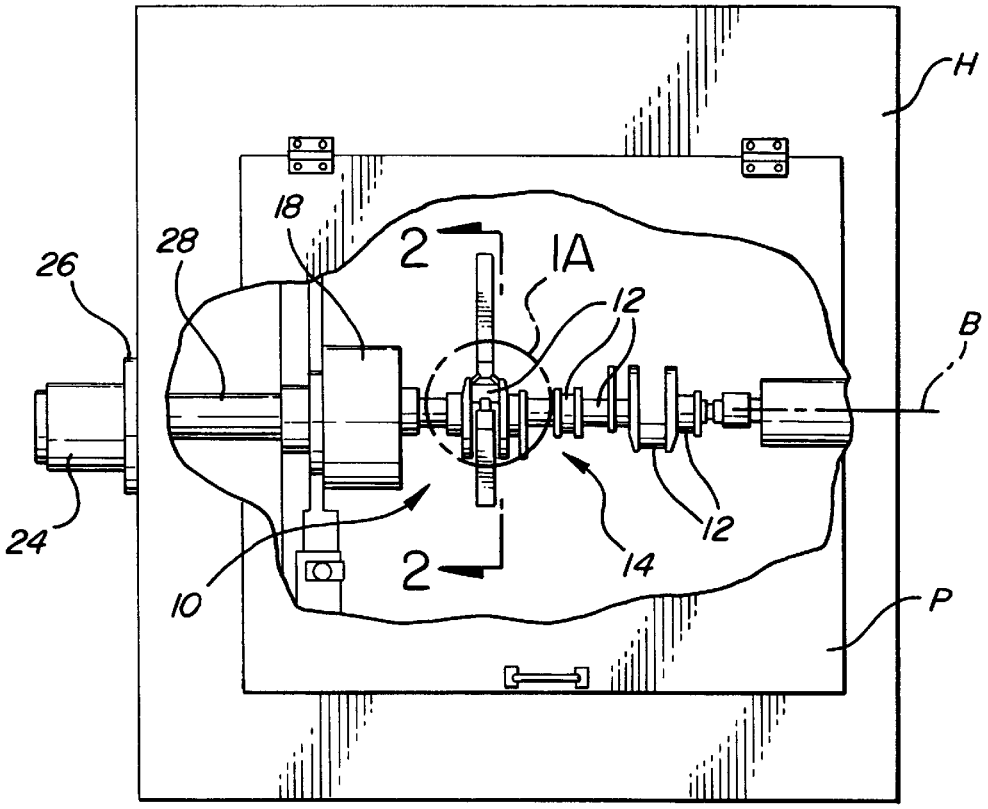
FIG. 1 is a schematic front view of a fillet rolling machine illustrating some basic principals of fillet rolling employed in the present invention.
Figure 1A:
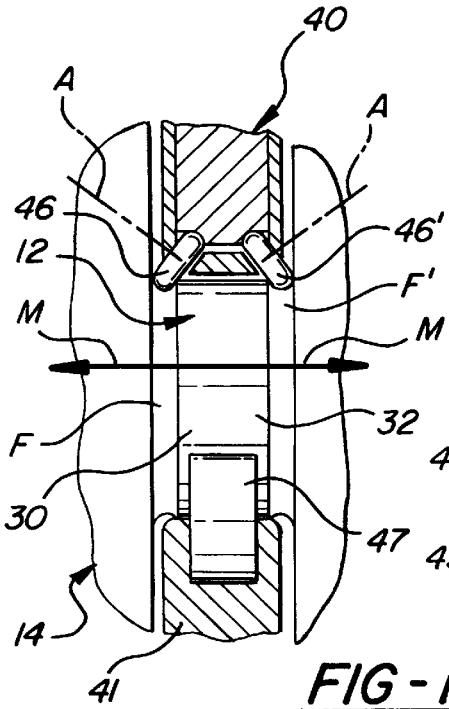
FIG. 1A is an enlarged view of the encircled portion 1A of FIG. 1 showing prior art tooling rolling the fillets of a crank pin journal.
Figure 2:
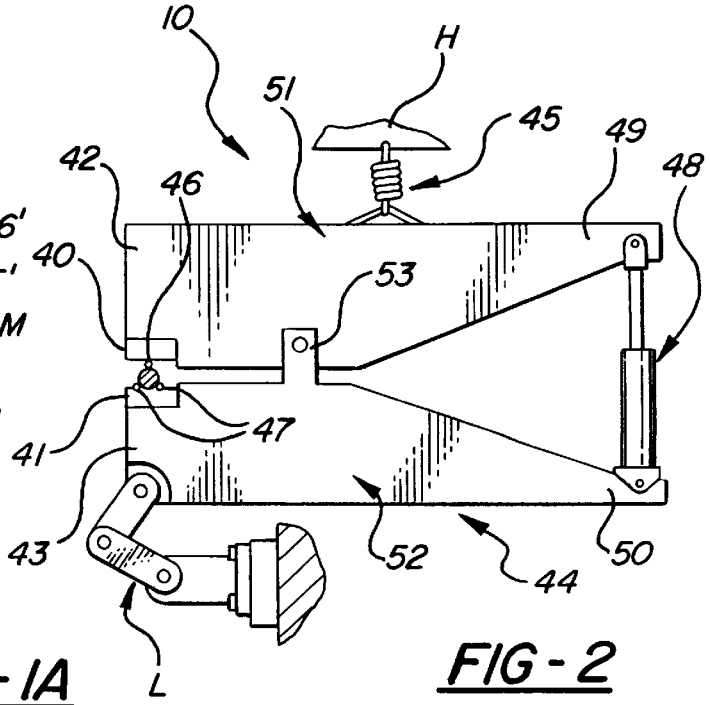
FIG. 2 is a schematic view of a portion of the machine of FIG. 1 taken generally along sight lines 2—2 of FIG. 1.
Figure 1B:
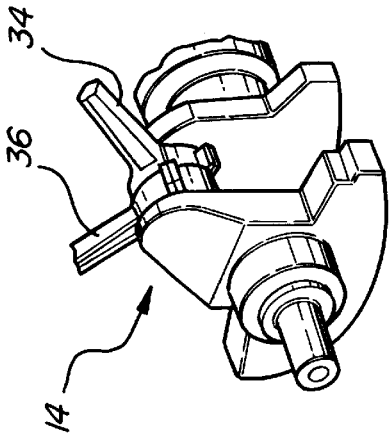
FIG. 1B is a pictorial view of a portion of a crankshaft with connecting rods mounted side-by-side on juxtapositioned pin journals.

FIGS. 1 and 2 diagrammatically show portions of a metal working machine 10 illustrating some construction and principals of deep roll strengthening of the fillets of journals 12 of a crankshaft 14. The crankshaft engine can be rotatably driven about horizontal axis B by a drive motor 24 supported by a mounting collar 26 on the machine housing and drivingly connected to the chuck 18 by drive shaft 28. The pin journals for the engine pistons have side-by-side and coaxial journal portions 30 and 32 (FIG. 1A) providing cylindrical bearings for the connecting rods 34, 36 (FIG. 1B) of opposing pistons in the left and right cylinders of V-block engines.

In view of the fact that the pin journal portions 30, 32 as well as the main journals experience high stress loads during engine operation, they are strengthened in various ways such as by deep roll hardening the radii of the undercuts of the laterally spaced annular fillets F, $F^1$ of the pin journal. Deep rolling directs high, concentrated forces to the annular fillet areas F, $F^1$ of the crankshaft 14. Such rolling produces compressive strengthening stresses in the metal of the crankshaft fillets that may, for example, extend to a depth of 4 mm.

As illustrated in FIG. 2, this is accomplished in the machine 10 by upper and lower tools 40 and 41 operatively mounted in the facing jaws 42, 43 of the pivotally interconnected arms of a load applying jaw assembly 44 forming a part of the machine. Jaw assembly 44 as well as others not shown are supported for operation by flexible support 45, diagrammatically shown, in a housing H accessed by hinged panel P.

The upper tool 40 has a pair of floating rollers 46, 46' of hardened steel or other suitable material which generally turn on oppositely inclined axes A and $A^1$ to engage and roll the laterally spaced fillets F, F' providing the annular joint areas or fillets between the journals and the adjacent counter weights or thrust faces of the crankshaft.

The lower tool 41 illustrative of the prior art has spaced support rollers 47 that provide the bearing and support for the journals as the crankshaft 14 is being rotatably driven about its axis B and the fillets are being rolled. Rolling pressure is hydraulically applied by the expansion force of a hydraulic cylinder 48 operatively connected between the extending ends 49, 50 of the upper and lower jaw arms 51, 52 pivoted together by a clevis mounted pivot 53 disposed at an intermediate position along the length of the jaw arms. This arrangement provides the mechanical advantage that amplifies the jaw closure force exerted to the jaw assembly by the expansion force of the hydraulic power cylinder 48.

In an automated machine and by virtue of the flexible support 45, the upper and lower jaws and their tools are supported to float around the axis of the orbiting journals during rolling. Rolling pressure exerted by the rollers 46, 46' can be increased and decreased by cylinder 48 during rotational drive of the crankshaft by motor 24 to impart concentrated annular residual stress patterns in the metal of the fillets F, $F^1$. These fillets are among the most highly stressed cross-sectional areas of the crankshaft in engine operation. The amount of pressure as well as the number of over rolls of the fillets can be preselected to roll compressive stresses into the metal and produce an optimized fatigue strength.

Prior to the present invention, linkage L diagrammatically shown in FIG. 2 has been operatively connected to the lower jaw 43 to limit any tendency of the jaw assembly and its tooling from lateral movement M relative to the pin journal 30, 32 that, for example, may result from a taper of the journal. However, even with such a linkage, lateral movement may occur to such an extent that the flanks or sides of portions of the crankshaft such as the counterweights or thrust faces of the crankshafts are contacted and abraded by the tools 40, 41. This may result in crankshaft part rejection and remachining or scrapping of the part.

The present invention is drawn to a new lower tool 141 which can be utilized with a jaw assembly such as assembly 44 to augment linkage L and the lateral movement control that it provides. The tool 141 can also be used with a jaw assembly such as 144 of FIG. 3 in which linkage L is eliminated since the support tool alone sufficiently eliminates lateral movement of the crankshaft for high quality fillet rolling. The upper tool 140 and rollers 146, 146' and other components of the jaw assembly 144 of FIG. 3 may be substantially the same as the jaw assembly of FIG. 2.

Figure 3:
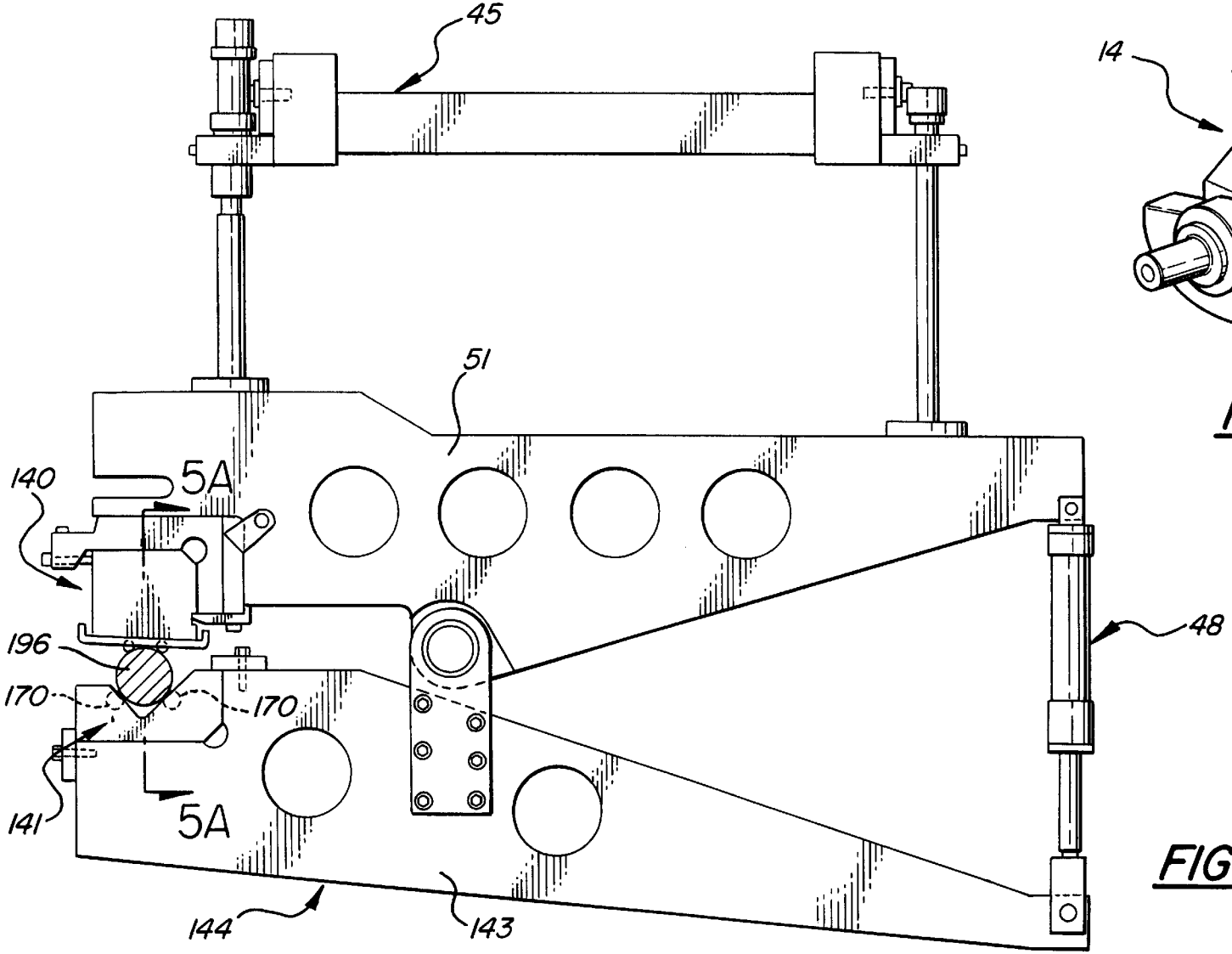
FIG. 3 is a side elevational view of another jaw assembly having tools according to this invention for rolling fillets of crankshaft pins.
Figure 5:
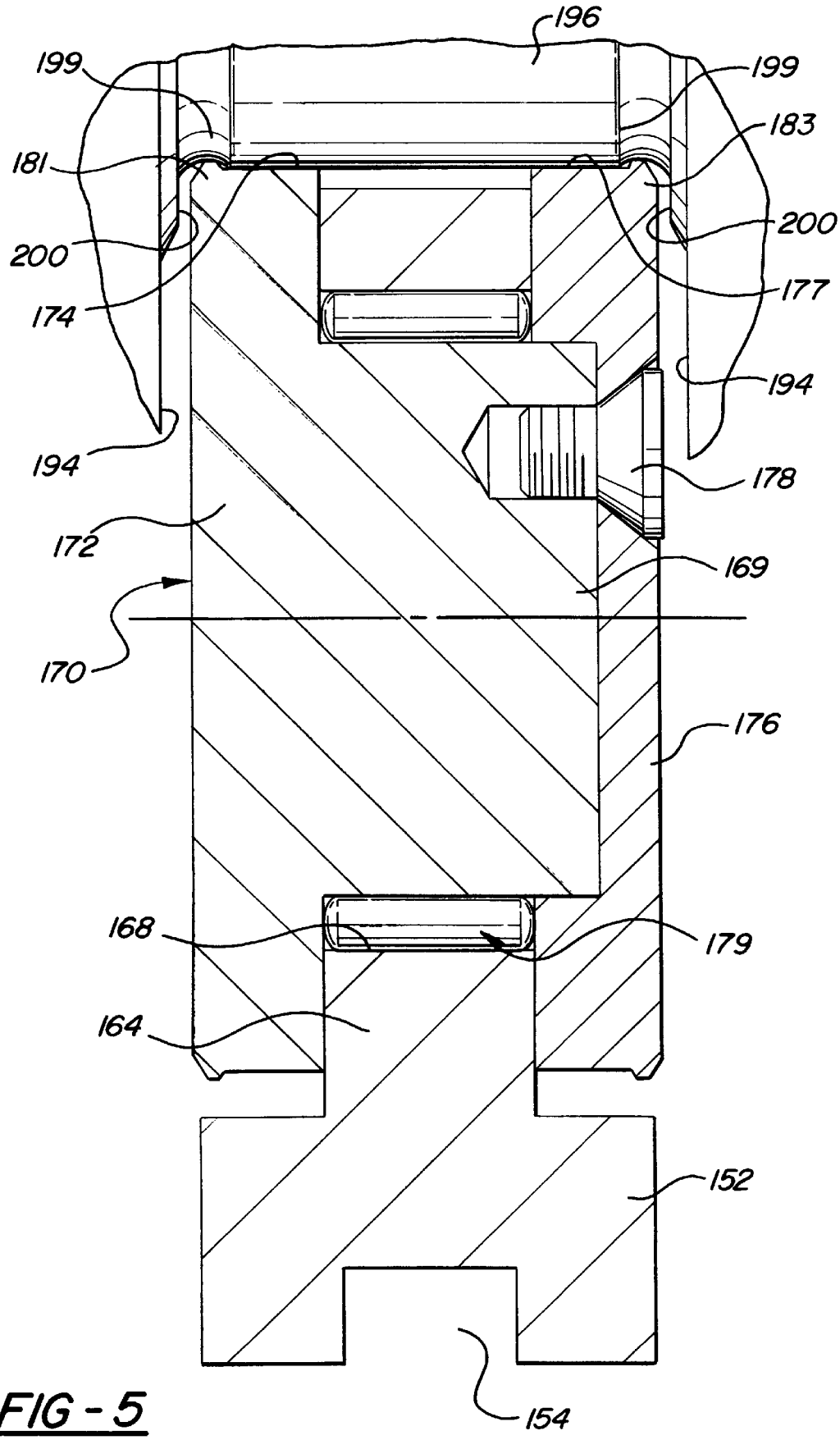
FIG. 5 is an enlarged cross-sectional view taken along line 5—5 of FIG. 4.

FIGS. 3 through 5 illustrate details of the new lower tool 141. This lower tool comprises a roller support housing 150 having an elongated base portion 152 with a mounting groove or key way 154 for attachment to the lower jaw arm 143. Extending upwardly from the base portion 152 is a flattened and centralized roller supporting web 164 provided with a pair of transversely directed annular openings 166, 168 therethrough (see FIGS. 4A and 4B). These openings receive the cylindrical shanks or hubs 169 of the compound support roller units 170 spaced from one another as shown in FIG. 4. Each of these roller units 170 comprises a first roller section 172 with a large diameter outer cylindrical surface 174 for contact with the journal and the smaller diameter shank portion 169 extending axially from the first roller section 172 through the associated transverse opening 166 or 168. A second roller section 176 is secured to the end of the shank 169 by threaded fasteners 178. The outer cylindrical surface 177 of the second roller section also provides rolling support with the crank pin journal. The roller units 170 are rotatably supported in the central web of the housing 150 by annular needle bearing units 179.

FIG. 5 best shows the laterally spaced annular retainer flanges 181, 183 which extend outwardly in a radial direction from the edges of the outer cylindrical surfaces 174, 177, respectively, of the compound roller. These annular flanges 181, 183 defining opposite sides of the support roller units 170, 170 have increased diameter as compared to the diameter of the journal bearing surface provided by cylindrical surfaces 170, 174 of the roller units 170. The flanges 181, 183 are work stabilizing and fit into the annular fillets of the journal 196 of the internal combustion engine crank 197 which corresponds to crank 14 of FIG. 1. These laterally spaced flanges 181, 183 are operative to contact portions of the pin journal fillets such as annular sides 199 during fillet rolling and are effective to limit the relative lateral movement between the crankshaft and the back-up and fillet rolling tools so that there is substantially no contact between the tools and the side surfaces 194 of the counterweights 195 or other surfaces such as thrust faces 200 that may be present to cause abrading or other damage to the crankshaft during the rolling procedures.

The invention has been described in an illustrative manner, and it is to be understood that the terminology, which has been used, is intended to be descriptive in nature rather than limitation.

Obviously, many modifications and variations of the present invention are possible in the light of the above teachings. It is, therefore, to be understood that within the scope of the appended claims the invention may be practiced otherwise than specifically described.

What is claimed is:

1. A fillet rolling machine adapted for deep rolling laterally spaced annular fillets between the journals and counterweights of a crankshaft for an internal combustion engine, the machine comprising:

a jaw assembly having a first facing jaw and an opposing second facing jaw, said first facing jaw having a first tool and said second facing jaw having a second tool;

said first tool having at least one roller adapted to engage and deep roll the fillets of the crankshaft for relieving stress and strengthening the crankshaft;

said second tool having at least two bearing and support rollers to operatively support the journal adjacent to the fillets being rolled at least one of said bearing and support rollers being a support roller unit, said support roller unit having an outer cylindrical surface for contacting and supporting said last mentioned journal and having an annular flange extending radially and outwardly from said outer cylindrical surface of said roller unit, said annular flange being adapted to fit into and coact with a crankshaft journal fillet and thereby limit lateral movement of said jaw assembly relative to the crankshaft to inhibit side contact between said jaw assembly and the tools with said crankshaft during fillet rolling operations.

2. The fillet rolling machine of claim 1 wherein said first tool has two laterally spaced rollers for deep rolling the laterally spaced annular fillets of the crankshaft and wherein each of said bearing and support rollers of said second tool is a support roller unit with a cylindrical support surface and with an annular flange extending outwardly therefrom for operatively engagement in the laterally spaced fillets.

3. The fillet rolling machine of claim 1 wherein said roller unit includes a pair of opposing annular flanges radially extending outwardly from said outer cylindrical surface, each of said flanges adapted to fit within and coact with a corresponding crankshaft journal fillet.

4. A lower support tool adapted for use on a jaw arm of a fillet rolling machine adapted for deep rolling the fillets of the journals of a crankshaft having counterweights, the lower support tool comprising:

a roller support housing adapted to be operatively attached to the jaw arm, said roller support housing having at least two transverse annular openings therethrough; and at least two spaced apart support rollers, each of said support rollers being received and retained in one of said annular openings and having an outer cylindrical surface for contacting and supporting the journals of the crankshaft, at least one of said support rollers being a roller unit, said roller unit having at least one radial and annular flange extending from said outer cylindrical surface of said at least one roller unit, said radial flange being adapted to fit within and coact with a crankshaft journal fillet to thereby limit the lateral movement of the jaw arm by locating the jaw arm relative to the crankshaft counterweights such that the jaw arm will not contact and damage the crankshaft counterweights.

5. The lower support tool of claim 4 wherein each of said spaced apart support rollers being a roller unit, each said roller unit having at least one radial and annular flange extending from an outer cylindrical surface thereof said radial flange being adapted to fit within and coact with a crankshaft journal fillet to thereby limit the lateral movement of the jaw arm by locating the jaw arm relative to the crankshaft counterweights such that the jaw arm contact and damage the crankshaft counterweights.

6. The lower support tool of claim 5 wherein each of said roller units includes a pair of opposing radial flanges extending outward from said outer cylindrical surface, each of said flanges adapted to fit within and coact with a corresponding journal fillet.

7. The lower support tool of claim 4 wherein said roller unit includes a first and second half and a plurality of fasteners, said first and second halves being secured together by said fasterners.

8. A roller unit adapted to support a crankshaft journal having a pair of opposing fillets, the roller unit comprising:

an outer cylindrical surface being adapted to rollingly engage the crankshaft journal whereby said cylindrical surface supports said journal;

at least one flange extending outwardly from said outer cylindrical surface, said flange coacting with a crankshaft journal fillet thereby laterally locating the crankshaft relative to the roller unit.

9. The roller unit of claim 8 wherein said roller unit has a pair of radially extending annular flanges, said flanges being spaced apart and each operatively fitting in and coacting with a corresponding journal fillet.

10. The roller unit of claim 8, the roller unit further comprising first and second halves and a plurality of fasteners, said first and second halves being operatively secured together by said fasteners.

11. A work support tool for rotatably supporting a shaft for an internal combustion engine to be worked in a fillet rolling machine having a pair of jaws movable between opened and closed positions with respect to said shaft and with a fillet rolling tool operatively mounted on one of said jaws having fillets rollers supported thereon for operatively engaging and deep rolling the radii of annular undercuts formed at opposite sides of a cylindrical journal on the shaft, the support tool comprising a base member operatively mounted on another one of said jaws, at least one shaft support wheel operatively mounted on the base member, said support wheel having a cylindrical support surface for direct support and contact with the journal of said shaft and a pair of annular flanges outboard of the cylindrical support surface, each of said diameters of said annular flanges being greater than the diameter of said cylindrical support surface for operatively fitting into said annular undercuts to engage portions of said undercuts to limit the lateral movement of said shaft as said undercuts are being compressively rolled by said fillet rollers.

* * * * *